US006886930B2

(12) United States Patent
Hara et al.

(10) Patent No.: US 6,886,930 B2
(45) Date of Patent: May 3, 2005

(54) INK CARTRIDGE AND INK JET RECORD APPARATUS USING THE INK CARTRIDGE

(75) Inventors: Kazuhiko Hara, Nagano (JP); Keiji Matsumoto, Nagano (JP); Shinri Sakai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/830,092

(22) Filed: Apr. 23, 2004

(65) Prior Publication Data

US 2004/0196342 A1 Oct. 7, 2004

Related U.S. Application Data

(63) Continuation of application No. 10/147,313, filed on May 17, 2002, now Pat. No. 6,742,878.

(30) Foreign Application Priority Data

May 17, 2001 (JP) ..... P2001-148296
Jul. 5, 2001 (JP) ..... P2001-205163

(51) Int. Cl.[7] ..... B41J 2/175
(52) U.S. Cl. ..... 347/86
(58) Field of Search ..... 347/84–87, 93

(56) References Cited

U.S. PATENT DOCUMENTS 4,814,786 A 3/1989 Hoisington et al.
6,010,212 A 1/2000 Yamashita et al.
6,022,102 A 2/2000 Ikkatai et al.
6,050,680 A * 4/2000 Moriyama et al. ..... 347/85
6,193,364 B1 * 2/2001 Iida ..... 347/86
6,238,042 B1 5/2001 Kobayashi et al.
6,435,673 B1 8/2002 Hattori et al.
6,742,878 B2 * 6/2004 Hara et al. ..... 347/86

FOREIGN PATENT DOCUMENTS

EP 0 736 388 A2 10/1996
EP 0 803 364 A2 10/1997
EP 1 016 533 A1 7/2000

* cited by examiner

*Primary Examiner*—Manish Shah
*Assistant Examiner*—An H. Do
(74) *Attorney, Agent, or Firm*—Sughrue Mion, PLLC

(57) ABSTRACT

An ink cartridge is detachably connected to a record head and has a plurality of ink storage chambers 11 (containing third ink storage chamber 17) for containing ink whose concentration gradient occurs and an ink flow passage 18 for making the ink storage chambers communicate with each other. The ink flow passage 18 is implemented as such an ink flow passage where ink in a high-concentration ink layer a formed in a lower area in the ink storage chamber 11 and ink in a low-concentration ink layer b formed in an upper area flow and merge as ink is supplied to the record head.

3 Claims, 11 Drawing Sheets

INK CARTRIDGE AND INK JET RECORD APPARATUS USING THE INK CARTRIDGE

This is a continuation of application Ser. No. 10/147,313 filed May 17, 2002, now U.S. Pat. No. 6,742,878; the disclosure of which is incorporated herein by reference.

BACKGROUND OF THE INVENTION

This invention relates to an ink cartridge for supplying ink to a record head, and an ink jet record apparatus using the ink cartridge.

An ink jet record apparatus generally comprises a record head mounted on a carriage and moving in the width direction of record paper, and paper feed means for moving the record paper relatively in a direction orthogonal to the move direction of the record head.

Such an ink jet record apparatus prints on record paper by ejecting ink droplets from a record head based on print data.

A record head capable of ejecting black ink, yellow ink, cyan ink, and magenta ink, for example, is mounted on a carriage, and in addition to text print in black ink, full-color print is made possible by changing the ink ejection percentage.

Thus, ink cartridges for supplying black ink, yellow ink, cyan ink, and magenta ink to the record head are placed in the main unit of the apparatus.

In the ordinary ink jet record apparatus, the ink cartridges for supplying black ink, yellow ink, cyan ink, and magenta ink are mounted on a carriage, and are moved together with the carriage.

On the other hand, in this kind of record apparatus provided for an office or business, for example, to deal with a comparatively large amount of print, the large-capacity ink cartridge storing each ink is not placed on the carriage and is placed in the apparatus main unit.

A record apparatus of the type wherein main tanks as ink cartridges are placed in the apparatus main unit (cartridge holder), and subtanks are placed on a carriage on which a record head is mounted is also provided. Ink is respectively supplied from the main tanks to the subtanks via ink supply tubes, and further from the subtanks to the record head.

In such a record apparatus, to improve throughput, such a function is required that can replenish ink from the main tanks to the subtanks in succession to stably supply ink from the subtanks to the record head, while print is executed.

By the way, nowadays, demand for high-accuracy print quality grows, and there is a tendency of using ink containing pigment (pigment ink), for example, as print ink.

Such pigment ink has a large particle diameter of color material as compared with ink containing a dye (dye ink), and pigment is likely to be collected and concentrated in the bottom portion of a cartridge (ink storage chamber), and therefore a concentration distribution (non-uniformity in concentration) easily occurs in the ink in the cartridge.

Thus, there arises a technical problem in that the ink in the cartridge is not sufficiently mixed at the use time and uniform print density and quality cannot be obtained.

It is therefore an object of the invention to provide an ink cartridge for making it possible to sufficiently mix ink in the cartridge at the use time and therefore provide uniform print density and quality. Another object of the present invention is to provide an ink jet record apparatus using the ink cartridge.

SUMMARY OF THE INVENTION

To the end, according to the invention, there is provided an ink cartridge being detachably connected to a head of a record apparatus and comprising a plurality of ink storage chambers for containing ink causing concentration gradient, and an ink flow passage for communicating the ink storage chambers with one another. In the cartridge, the ink flow passage has such an ink flow passage as to cause ink in a high-concentration ink layer formed in a lower area in the ink storage chamber and ink in a low-concentration ink layer formed in an upper area in the ink storage chamber to flow and merge with each other as ink is supplied to the record apparatus head.

Since the ink cartridge is thus configured, when ink is supplied to the record apparatus head, the ink in the high-concentration ink layer in the ink storage chamber and the ink in the low-concentration ink layer in the ink storage chamber flow and merge in the ink flow passage.

Therefore, the ink in the high-concentration ink layer and the ink in the low-concentration ink layer are mixed for supply to the record apparatus head, so that uniform print density and quality can be obtained.

Here, it is desirable that the ink storage chambers comprise a plurality of upper ink storage chambers including a head connection ink storage chamber that can be connected to the record apparatus head, and an atmosphere open lower ink storage chamber opened to the atmosphere in the connection state to the record apparatus head.

Since the ink cartridge is thus configured, ink is supplied to the record apparatus head by causing ink to flow from the lower ink storage chamber to the upper ink storage chamber.

It is desirable that the ink flow passage is formed with a first communication port opened to the inside of the high-concentration ink layer and a second communication port opened to the inside of the low-concentration ink layer.

Since the ink cartridge is thus configured, when ink is supplied to the record apparatus head, the ink in the high-concentration ink layer flows through the first communication port into the ink flow passage, the ink in the low-concentration ink layer flows through the second communication port into the ink flow passage, and the ink in the high-concentration ink layer and the ink in the low-concentration ink layer merge in the ink flow passage.

Further, it is desirable that the first-communication port is disposed at the lowest position in the gravity direction in the ink storage chamber.

Since the ink cartridge is thus configured, the ink at the lowest position in the gravity direction in the ink storage chamber flows through the first communication port into the ink flow passage.

Further, it is desirable that the flow amount ratio between the flow amount a of ink passing through the first communication port and the flow amount b of ink passing through the second communication port, a:b, is set in the range of 1:1 to 1:3.

Since the ink cartridge is thus configured, it is possible to avoid such a case that the flow-through resistance of the first communication port becomes too large as compared with that of the second communication port (the flow-through resistance ratio becomes insufficient) and the flow amount of ink passing through the first communication port is lessened.

A partition wall having both the communication ports is provided in the upper ink storage chamber.

Since the ink cartridge is thus configured, in the upper ink storage chamber, when ink is supplied to the record apparatus head, the ink in the high-concentration ink layer flows through the first communication port into the ink flow passage, the ink in the low-concentration ink layer flows through the second communication port into the ink flow passage, and the ink in the high-concentration ink layer and the ink in the low-concentration ink layer merge in the ink flow passage.

An ink guide path for causing ink to flow from a storage chamber upper part to a storage chamber lower part in an ink supply state can also be provided in the upper ink storage chamber.

Since the ink cartridge is thus configured, in the upper ink storage chamber, when ink is supplied to the record apparatus head, when ink passes through the ink guide path, it flows from the storage chamber lower part to the storage chamber upper part while it is mixed.

On the other hand, according to the invention, there is provided an ink jet record apparatus comprising a carriage for mounting a head, that can be reciprocated between a print area and a non-print area, using any of the ink cartridges described above.

According to the configuration, when ink is supplied to the record apparatus head, the ink in the high-concentration ink layer in the ink storage chamber and the ink in the low-concentration ink layer flow and merge in the ink flow passage.

Therefore, the ink in the high-concentration ink layer and the ink in the low-concentration ink layer are mixed for supply to the record apparatus head, so that there cab be provided the ink jet record apparatus that can provide uniform print density and quality.

The present disclosure relates to the subject matter contained in Japanese patent application Nos. 2001-148296 (filed on May 17, 2001), and 2001-205163 (filed on Jul. 5, 2001), which are expressly incorporated herein by reference in their entireties.

DESCRIPTION OF THE PREFERRED EMBODIMENT

Referring now to the accompanying drawings, preferred embodiments of an ink cartridge and an ink jet record apparatus using the ink cartridge incorporating the invention will be discussed.

Figure 1:
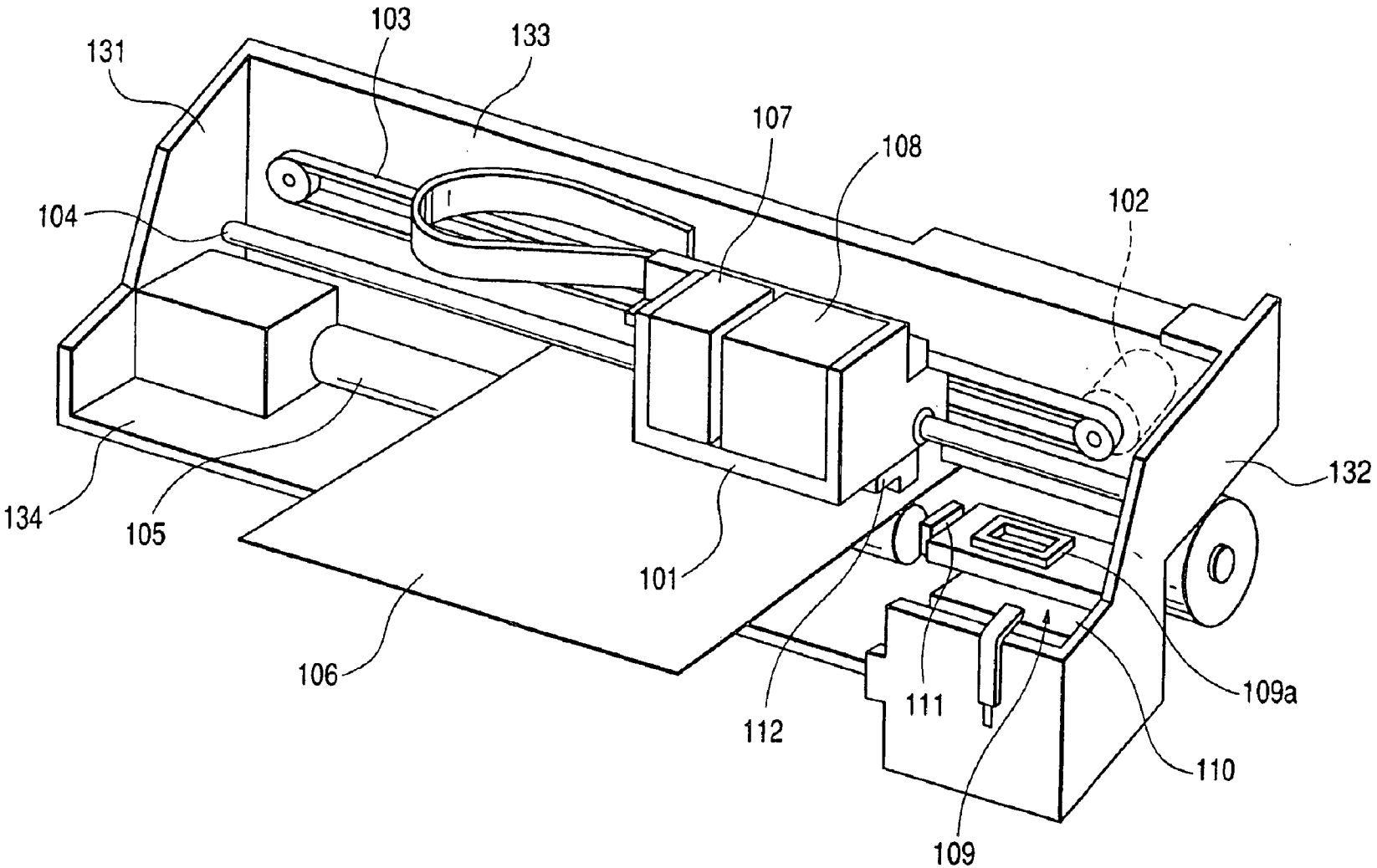
FIG. 1 is a perspective view to show an outline of the basic configuration of an ink jet record apparatus according to an embodiment of the invention.

To begin with, an ink jet record apparatus will be discussed with reference to FIG. 1. FIG. 1 is a perspective view to show an outline of the general configuration of the ink jet record apparatus according to an embodiment of the invention.

In FIG. 1, a carriage indicated by numeral 101 can be reciprocated in the axial direction of a platen 105 as guided by a guide member 104 via a timing belt 103 driven by a carriage motor 102.

The guide member 104 is supported on two left and right frames 131 and 132 opposed to each other. Both the frames 131 and 132 are joined by a rear plate 133 and a bottom plate 134.

An ink jet record head 112 is mounted on the lower face portion of the carriage 101 so that it is opposed to record paper 106. A black ink cartridge 107 and a color ink cartridge 108 for supplying ink to the record head 112 are detachably held on the upper face portion of the carriage 101.

A capping system 109 having a cap member 109*a* is disposed in a non-print area (home position) in a movable area of the carriage 101. When the record head 112 moves just above the capping system 109, the capping system 109 can move up so as to seal the nozzle formation face of the record head 112. A tube pump 110 as a pump unit to give a negative pressure to the internal space of the cap member 109*a* is disposed below the capping system 109.

The capping system 109 has a function as a lid for preventing nozzle openings of the record head 112 from being dried during the nonoperating period of the ink jet record apparatus. It also has a function as an ink receiver during the flushing operation of applying a drive signal not involved in print to the record head 112 for idly ejecting ink droplets, and a function as a cleaning system for causing a negative pressure from the tube pump 110 to act on the record head 112 for sucking ink.

A wiping system 111 comprising an elastic plate of rubber, etc., is disposed in the proximity of the print area side of the capping system 109 so that it can advance and retreat in a horizontal direction. When the carriage 101 reciprocates on the capping system 109 side, the wiping system 111 can advance into the moving path of the record head 112.

Figure 2A:
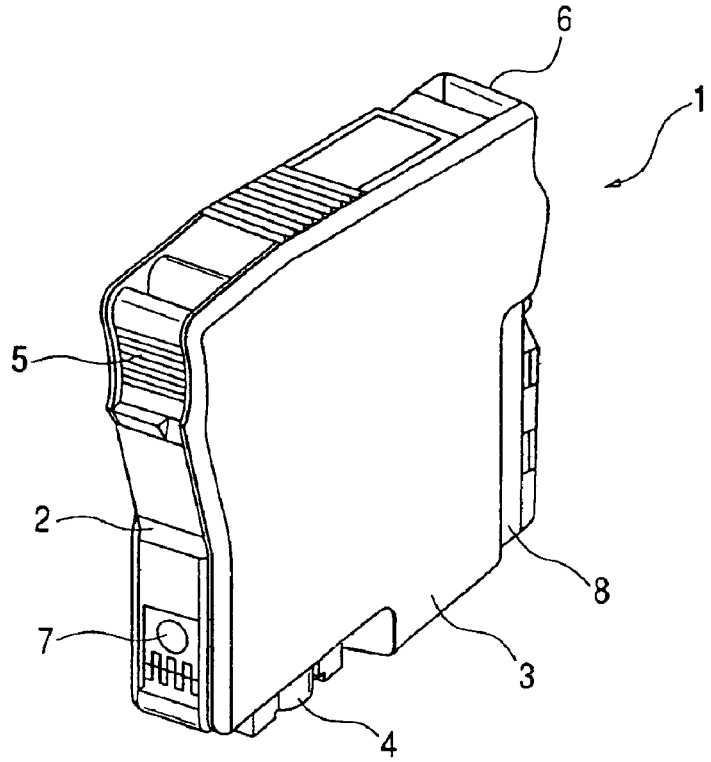
FIGS. 2(*a*) and 2(*b*) are perspective views to show the appearance of the ink cartridge according to a first embodiment of the invention.
Figure 2B:
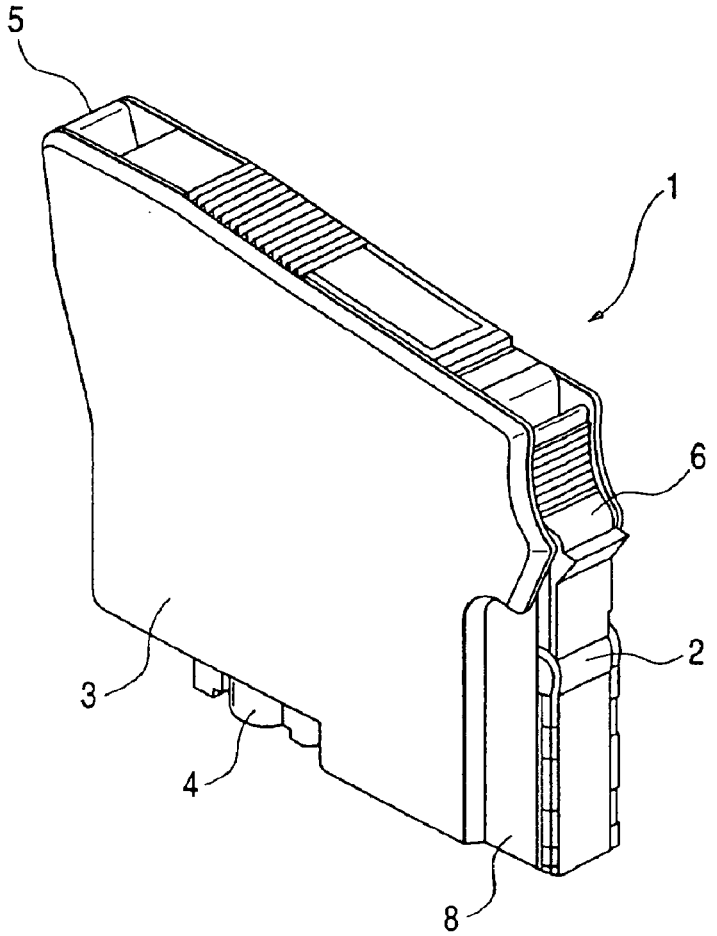
Figure 3:
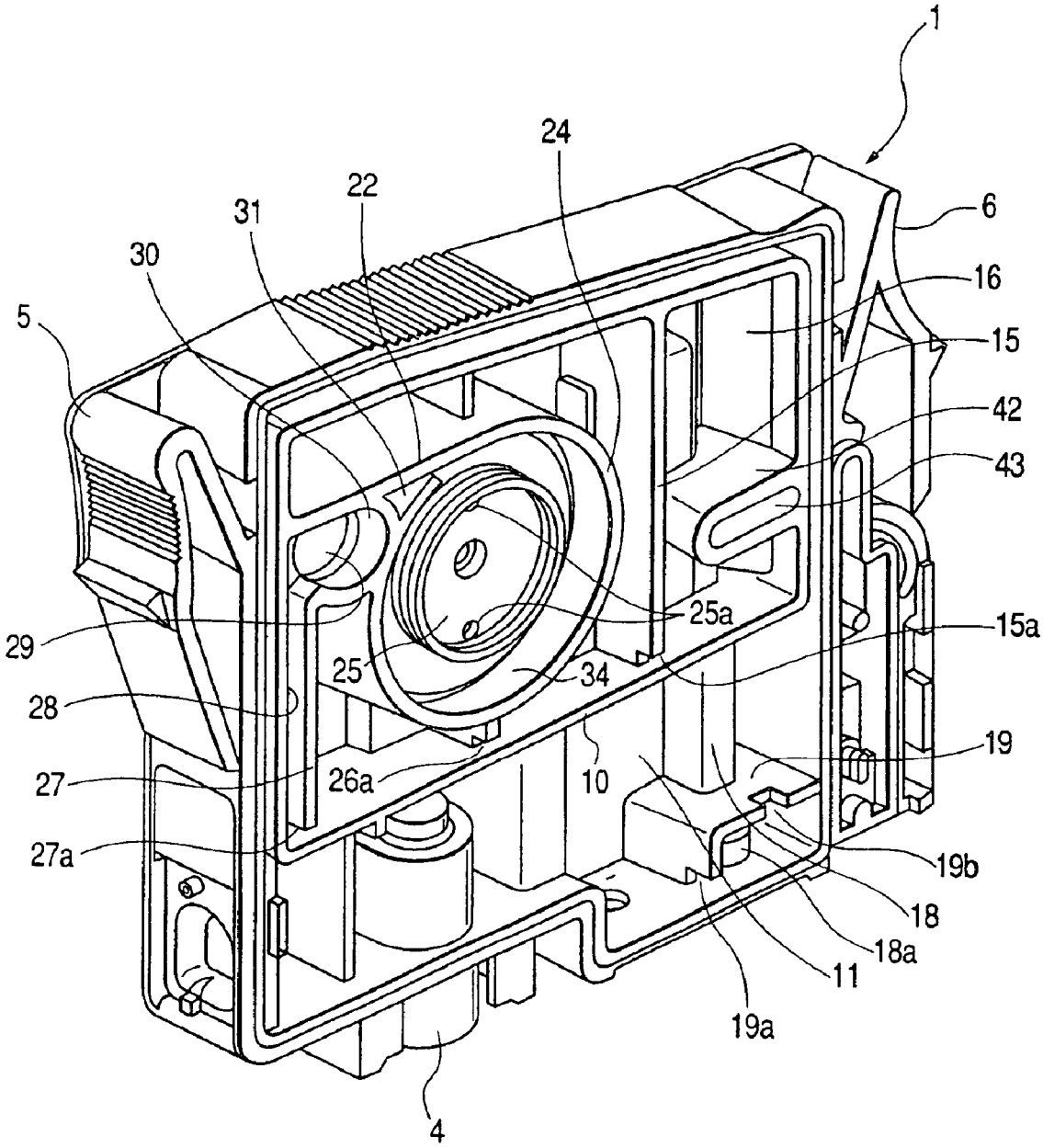
FIG. 3 is a perspective view showing the internal structure of the ink cartridge according to the first embodiment of the invention as viewed from upward in a slanting direction.
Figure 4:
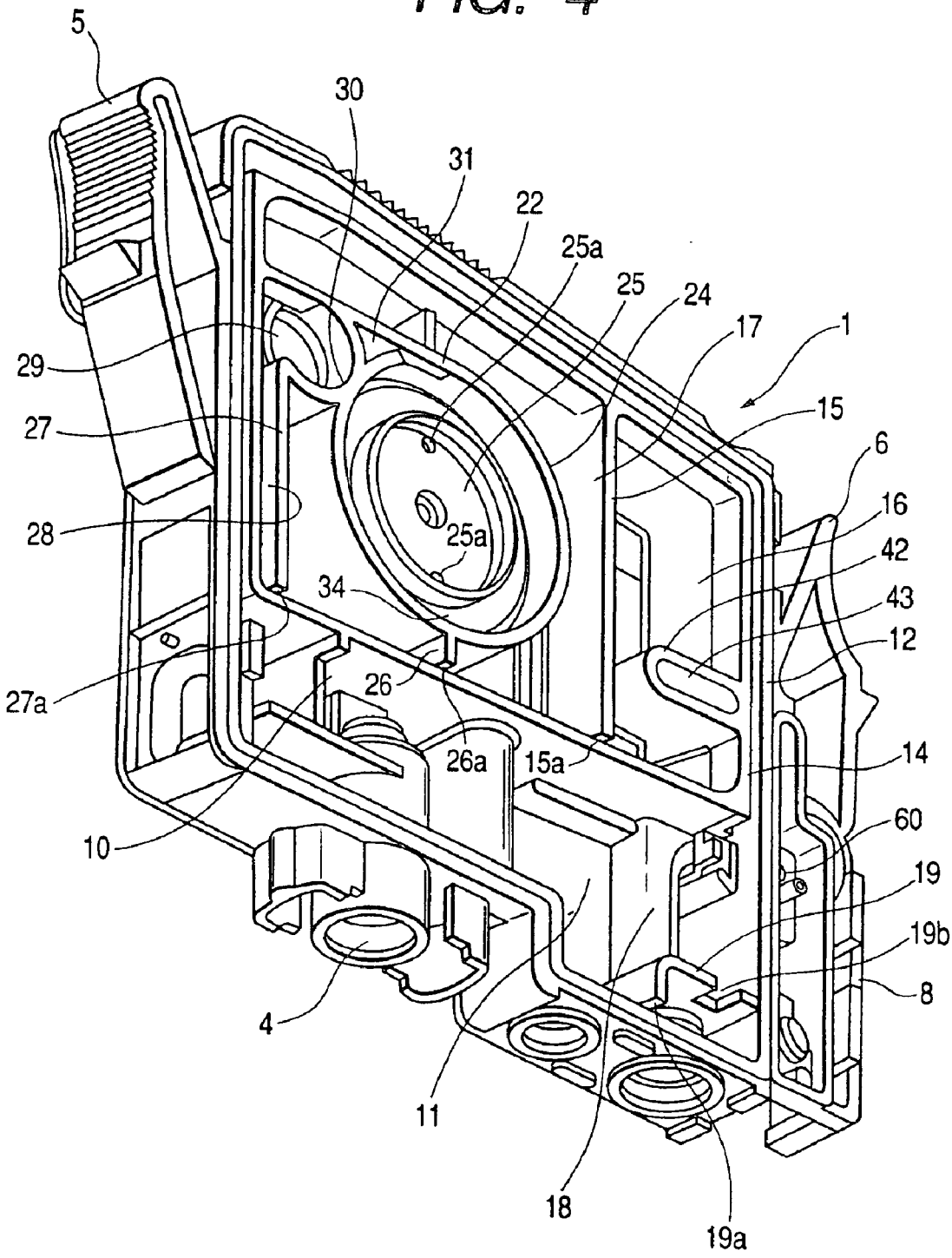
FIG. 4 is a perspective view showing the internal structure of the ink cartridge according to the first embodiment of the invention as viewed from downward in a slanting direction.
Figure 5:
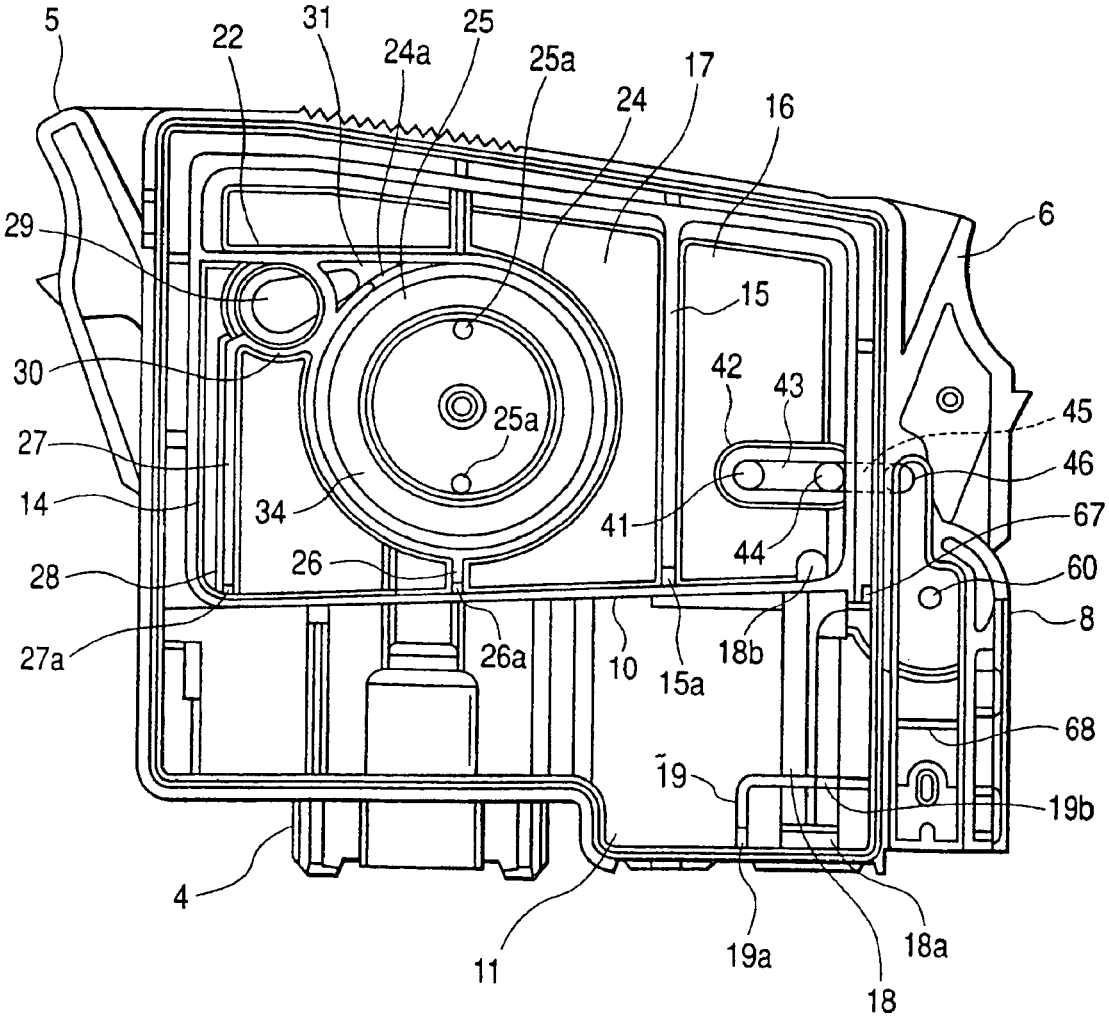
FIG. 5 is a front view to show the internal structure of the ink cartridge according to the first embodiment of the invention.
Figure 6:
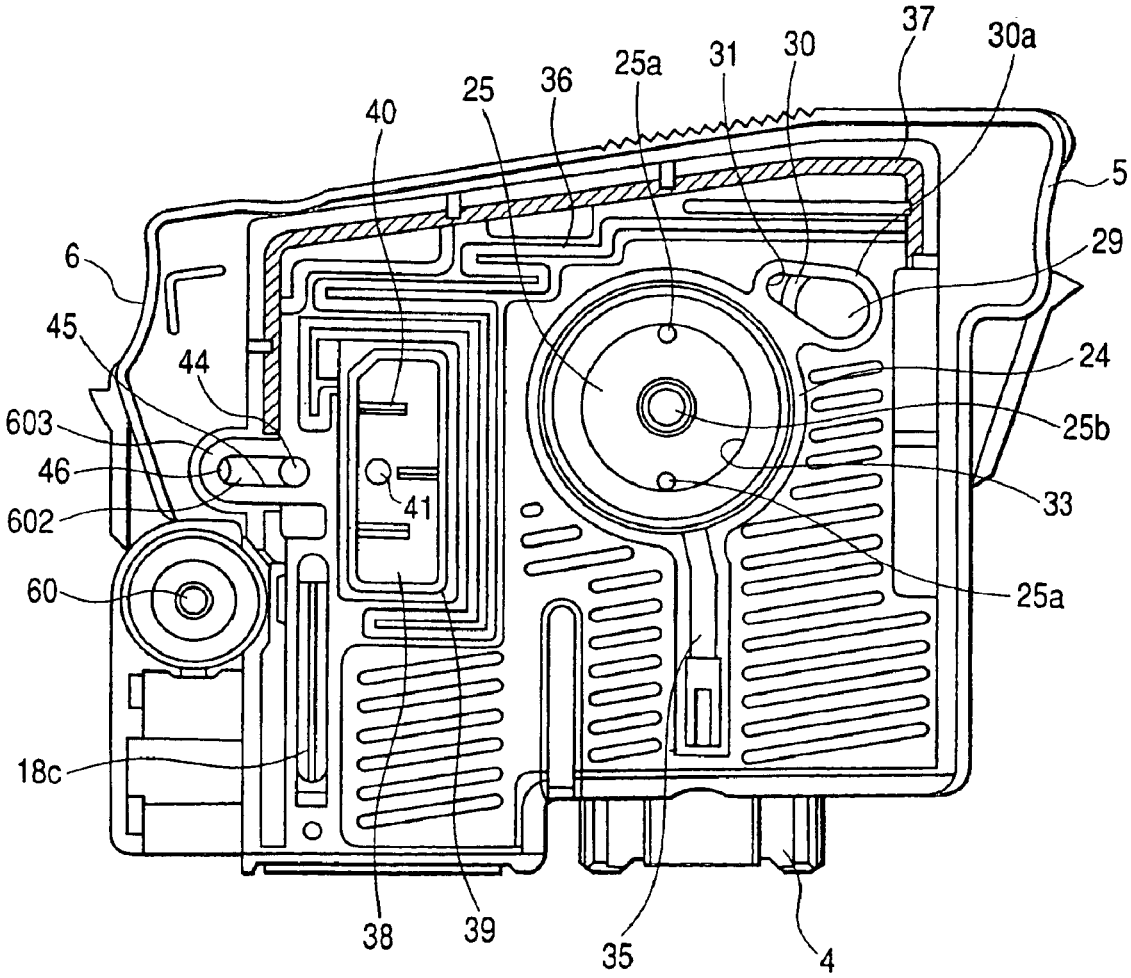
FIG. 6 is a rear view to show the internal structure of the ink cartridge according to the first embodiment of the invention.
Figure 7:
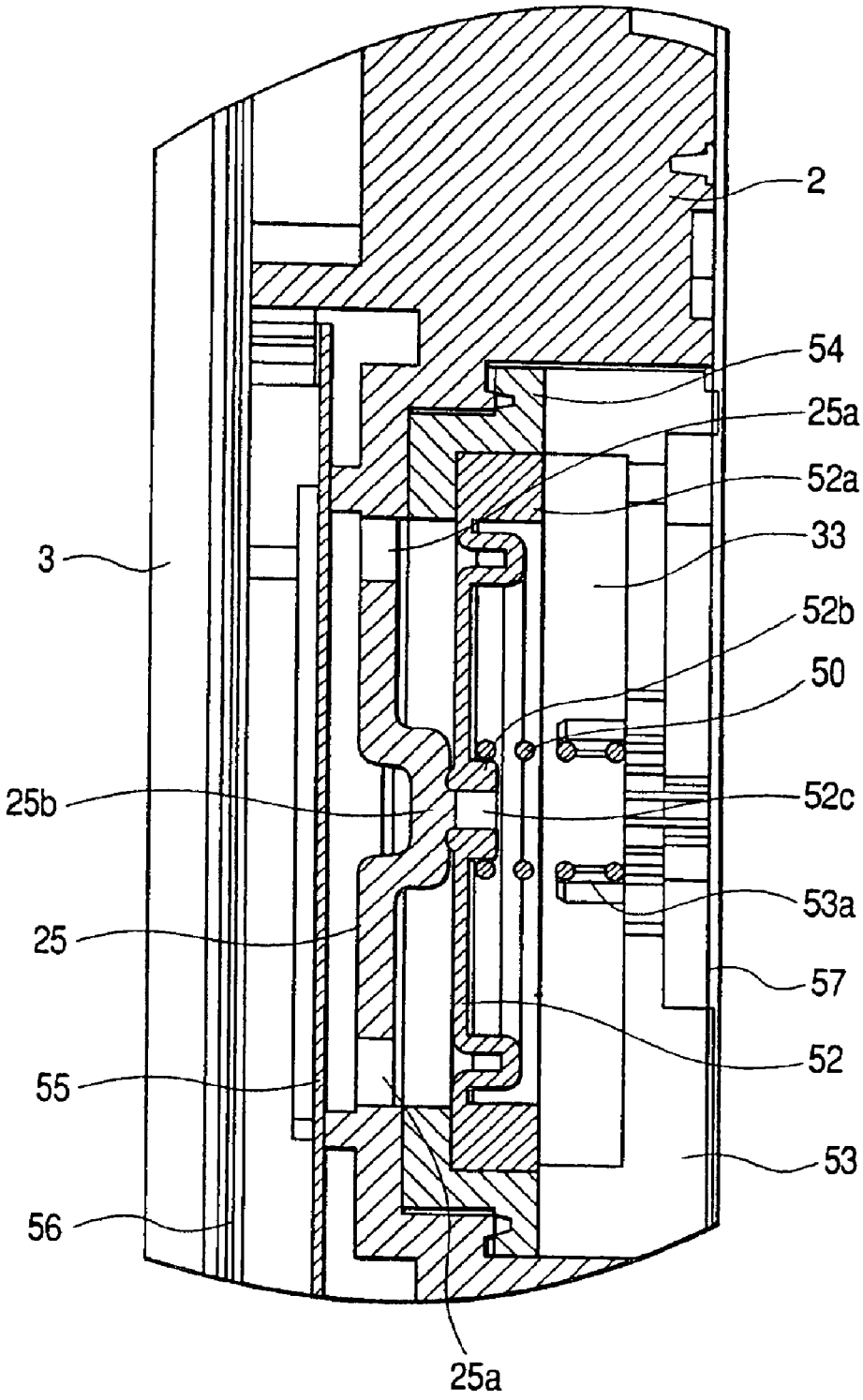
FIG. 7 is an enlarged sectional view to show a negative pressure generation system storage chamber of the ink cartridge according to the first embodiment of the invention.
Figure 8:
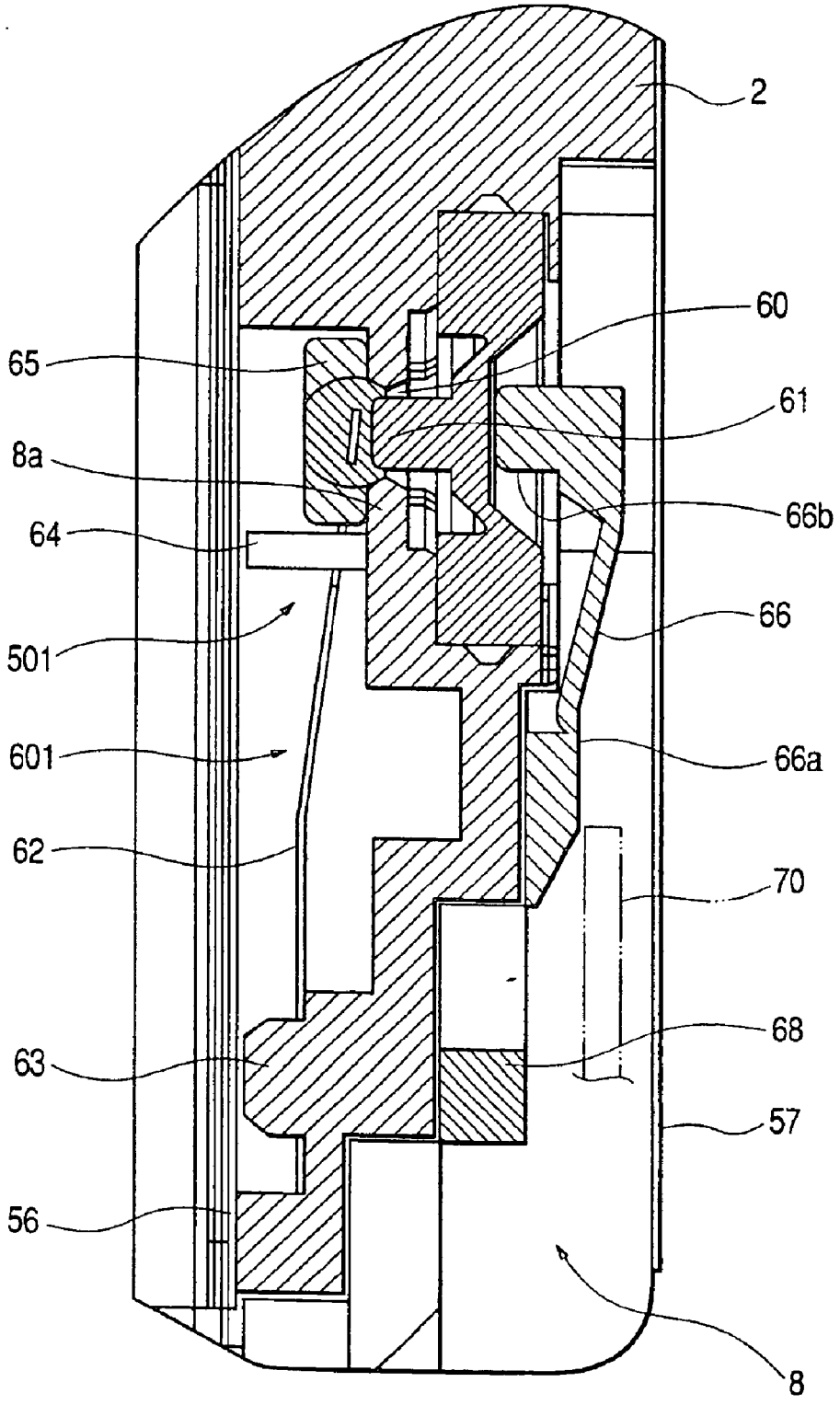
FIG. 8 is an enlarged sectional view to show a valve storage chamber of the ink cartridge according to the first embodiment of the invention.
Figure 9:
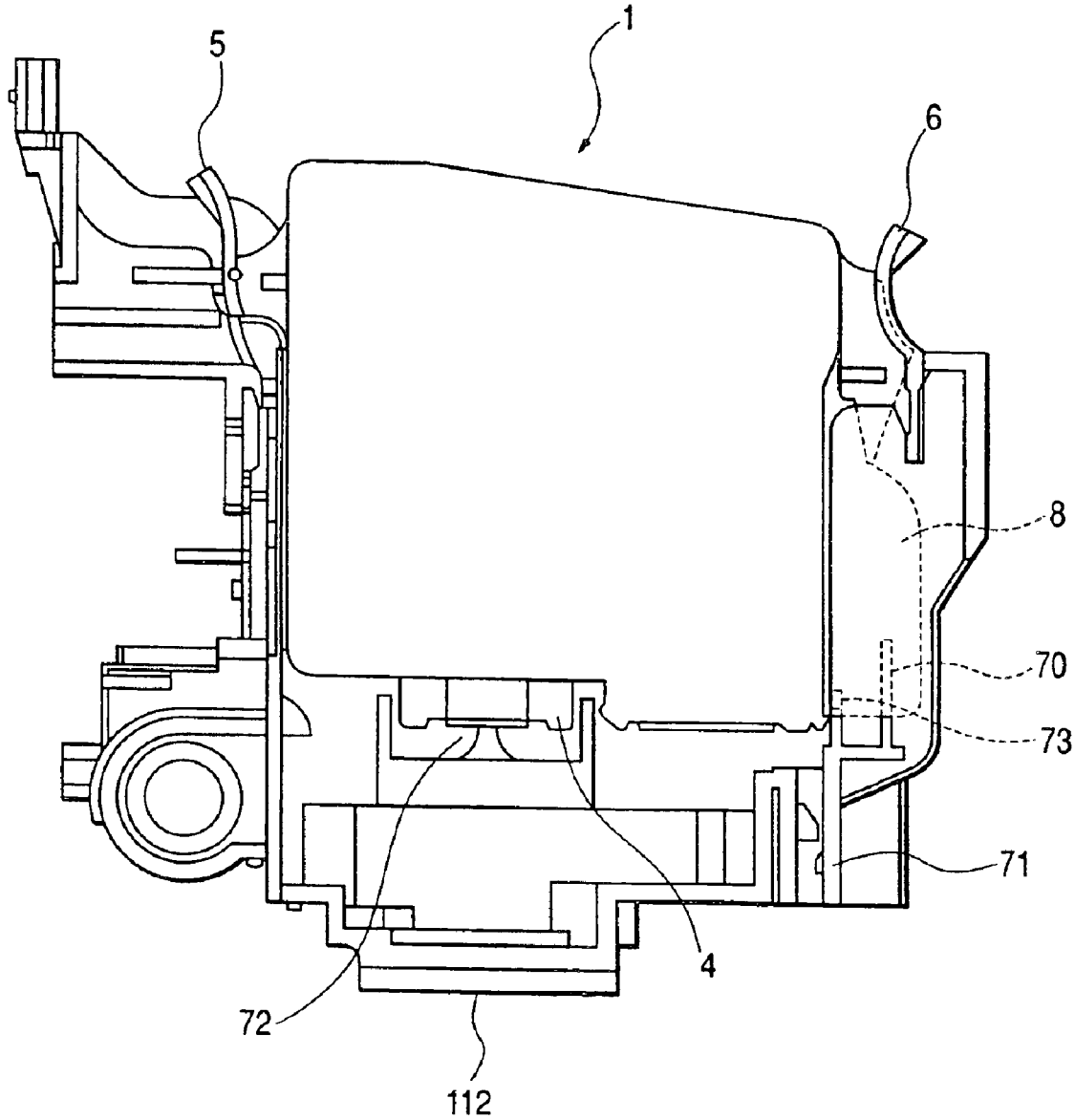
FIG. 9 is a front view to show the connection state of the ink cartridge according to the first embodiment of the invention to a cartridge holder.
Figure 10A:
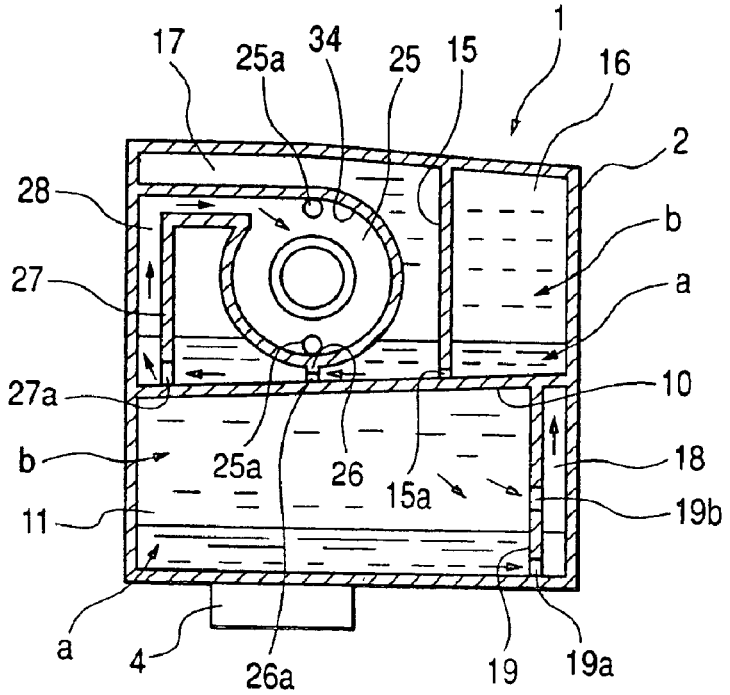
FIGS. 10(*a*) and 10(*b*) are sectional views to schematically show the internal structure of the ink cartridge according to the first embodiment of the invention to describe an ink flow passage in the ink cartridge.
Figure 10B:
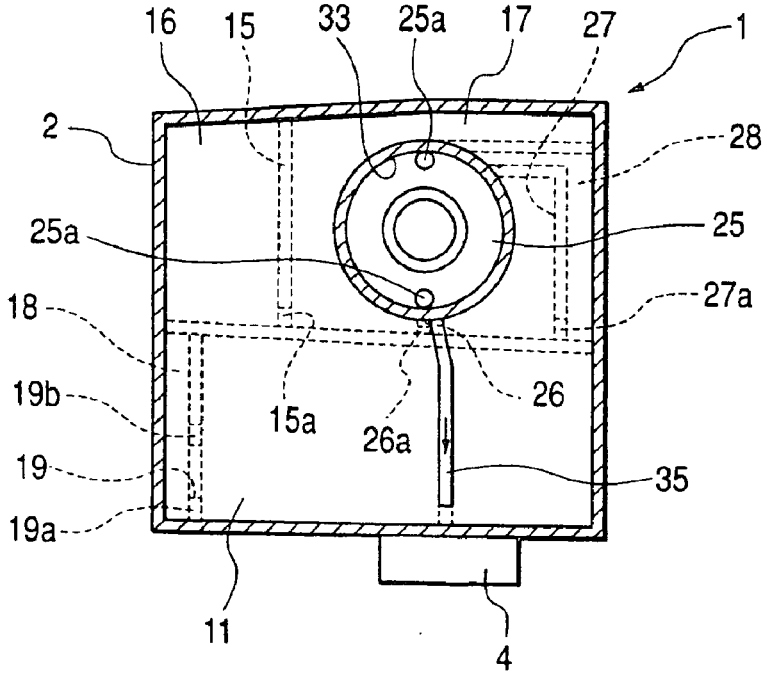

Next, an ink cartridge used with the described ink jet record apparatus will be discussed with reference to FIGS. 2 to 10. FIGS. 2(*a*) and 2(*b*) are perspective views to show the appearance of the ink cartridge according to a first embodiment of the invention. FIGS. 3 and 4 are perspective views showing the internal structure of the ink cartridge according to the first embodiment of the invention as viewed from upward and downward in a slanting direction. FIGS. 5 and 6 are a front view and a rear view to show the internal structure of the ink cartridge according to the first embodiment of the invention. FIGS. 7 and 8 are enlarged sectional views to show a negative pressure generation system storage chamber and a valve storage chamber of the ink cartridge according to the first embodiment of the invention. FIG. 9 is a front view to show the connection state of the ink cartridge according to the first embodiment of the invention to a cartridge holder. FIGS. 10(*a*) and 10(*b*) are sectional views to schematically show the internal structure of the ink cartridge according to the first embodiment of the invention to describe an ink flow passage in the ink cartridge.

An ink cartridge 1 shown in FIGS. 2(*a*) and 2(*b*) (black ink cartridge 107, color ink cartridge 108 in FIG. 1) has a container main body 2 having an almost flat shape rectangular in a plane view, which is opened to one side, and also has a lid body 3 for sealing the opening of the container main body 2.

The container main body 2 is formed in the lower portion with an ink supply port 4 that can be connected to an ink supply needle 72 of a record head 112 (both are shown in FIG. 9). Retention members 5 and 6, which can be attached to and detached from a cartridge holder, are provided integrally on the upper sides of the container main body 2. A memory device 7 is disposed below one retention member 5, and a valve storage chamber 8 is disposed below the other retention member 6.

The ink supply port 4 stores a valve body (not shown) therein, which is opened and closed as the ink supply needle is inserted and removed.

As shown in FIG. 8, the valve storage chamber 8 has an internal space opened to the cartridge insertion side (lower side), so that an identification piece 73 (shown in FIG. 9) and a valve operation rod 70 on the record apparatus matching with the ink cartridge 1 can advance and retreat in the internal space. The upper part of the internal space contains an operation arm 66 rotated as the valve operation rod 70 advances and retreats, and an identification convex part (s) 68 for determining whether or not the ink cartridge matches with a given record apparatus is formed in the lower part of the internal space. The identification convex part 68 is disposed at such a position as to complete the determination by the valve operation rod 79 (the identification piece 73) of a cartridge holder 71 (shown in FIG. 9) before the ink supply needle 72 is made to communicate with the ink supply port 4 (before an atmospheric open valve described later is opened).

A through hole 60 opened and closed by the opening and closing operation of an atmospheric open valve 601 is formed in a chamber wall 8*a* of the valve storage chamber 8, as shown in FIG. 8. The operation arm 66 is placed on one opening side of the through hole 60, and the atmospheric open valve 601 is placed on the other opening side of the through hole 60. The operation arm 66 has an operation part 66*b* for pressing a press member 61, and is disposed to project in an upward slanting direction into the entry path of the valve operation rod 70, and is fixed to the container main body 2 through a rotation supporting point 66*a*.

The press member 61 is attached to the chamber wall 8*a* so as to close the through hole 60, and the whole of the press member 61 is formed of an elastic member of rubber, etc. The internal space formed between the press member 61 and the opening peripheral margin of the through hole 60 is opened to a through hole 67 communicating with a first ink storage chamber 11 (both are shown in FIG. 5).

The atmospheric open valve 601 has a valve body 65 urged constantly against the opening peripheral margin of the through hole 60 as shown in FIG. 8. The valve body 65 has an elastic member 62, the movement of which is regulated by a projection 64, and the elastic member 62 is fixed at a lower end part to the container main body 2 through a projection 63.

Next, the internal space of the container main body 2 (inside of the ink cartridge) will be discussed. The inside of the ink cartridge is mainly constructed by an ink flow passage system and an air flow passage system, and therefore the ink flow passage system and the air flow passage system will be discussed separately. The main part of the invention is directed to the ink flow passage having a complicated structure wherein ink in a high-concentration ink layer and ink in a low-concentration ink layer flow and merge (passage where ink flows in the ink cartridge), and therefore the ink flow passage system will be discussed particularly in detail. The ink flow passage system will be discussed in the order of "ink flow operation" and "configuration of ink flow passage".

[Ink Flow Passage System]

[Ink Flow Operation]

When ink supply to the record head 112 (shown in FIGS. 1 and 9) is started, ink in a high-concentration ink layer a in the first ink storage chamber 11 flows from a communication port 19*a* via a communication port 18*a* (shown in FIG. 5) into a communication flow passage (flow passage connecting the first ink storage chamber 11 and a second ink storage chamber 16) 18. On the other hand, ink in a low-concentration ink layer b in the first ink storage chamber 11 flows from a communication port 19*b* via the communication port 18*a* into the communication flow passage 18. The ink in the high-concentration ink layer a and the ink in the low-concentration ink layer b flowing into the communication flow passage 18 merge and further move up in the communication flow passage 18 to flow toward the second ink storage chamber 16.

In this case, the communication ports 19*a* and 18*a* are disposed at the same height positions, so that the ink in the first ink storage chamber 11 is introduced into the second ink storage chamber 16 along the communication flow passage 18 without being left.

Figure 11:
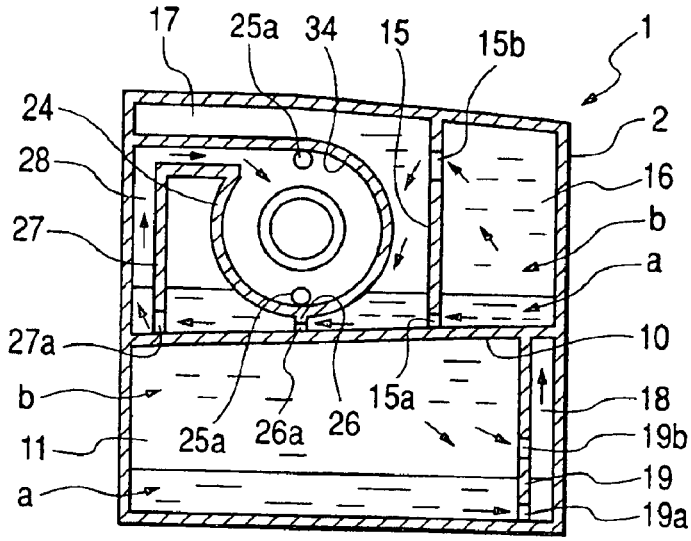
FIG. 11 is a sectional view to schematically show the internal structure of an ink cartridge according to a second embodiment of the invention.
Figure 12:
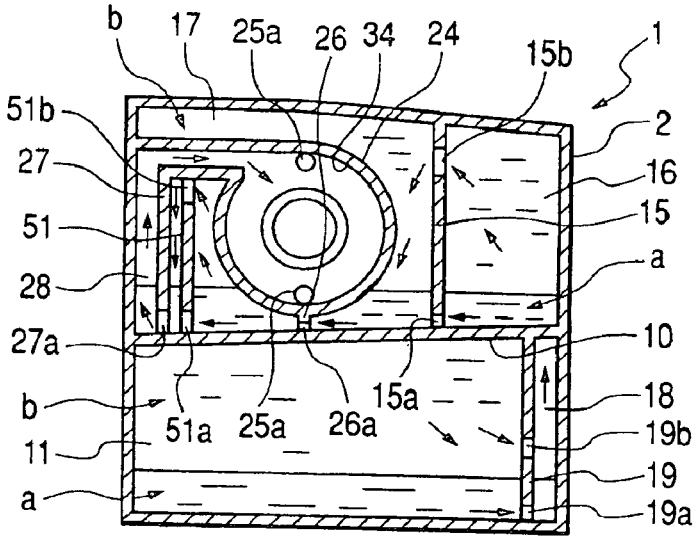
FIG. 12 is a sectional view to schematically show the internal structure of an ink cartridge according to a third embodiment of the invention.
Figure 13:
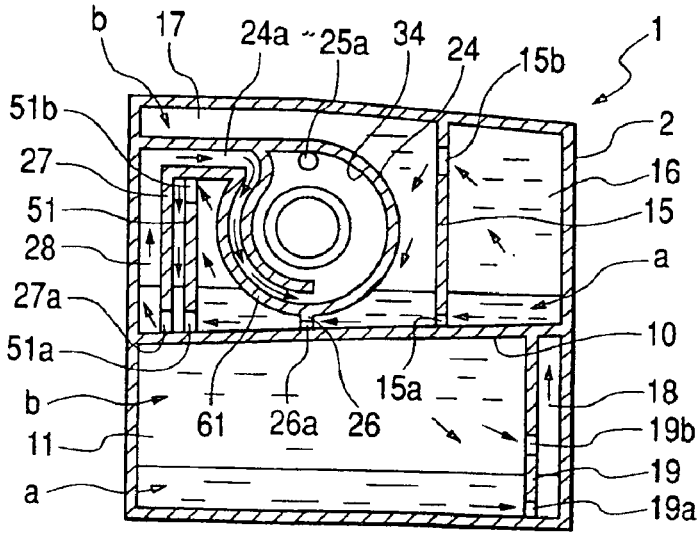
FIG. 13 is a sectional view to schematically show the internal structure of an ink cartridge according to a fourth embodiment of the invention.

In FIGS. 10 to 13 (FIG. 11 shows a second embodiment, FIG. 13 shows a third embodiment, and FIG. 13 shows a fourth embodiment), the communication port 18*a* is not shown.

Next, the ink flowing from the first ink storage chamber 11 via the communication flow passage 18 into the second ink storage chamber 16 merges with the ink in the high-concentration ink layer a in the second ink storage chamber 16, and further passes through a communication port 15*a* of a vertical wall 15, flows into a third ink storage chamber 17, and passes through a communication port 26*a* of a partition wall 26, as indicated by the arrows in FIG. 10(*a*). The ink passing through the communication port 26*a* of the partition wall 26 passes through a communication port 27*a* of a partition wall 27, and further moves up in an ink flow passage 28, and flows through a communication port 24*a* into a filter chamber 34, as indicated by the arrows in FIG. 10(*a*).

After this, the ink passes through through holes 25*a* of a partition wall 25, and flow into a differential pressure regulating valve storage chamber 33, and as a differential pressure regulating valve (membrane 52 shown in FIG. 7) is opened, the ink passes through a through hole 52*c* and arrives at the ink supply port 4 via a recess part 35, as shown in FIG. 10(*b*).

[Configuration of Ink Flow Passage]

The ink cartridge 1 is formed with an internal space by joining the lid body 3 to the container main body 2 and further joining an air shield film to the rear of the container main body 2. The internal space is divided into upper and lower parts by a partition wall 10 extending slightly downward toward the ink supply port side opposed to the record head 112, as shown in FIGS. 3 to 5. The lower area of the internal space provides the first ink storage chamber 11 opened to the atmosphere in the connection state to the record head 112. On the other hand, the upper area of the internal space is defined by a frame 14 with the partition wall 10 as a bottom part. The internal space of the frame 14 is divided into left and right parts by the vertical wall 15 having the communication port 15*a*. One of the areas into which the internal space is divided provides the second ink storage chamber 16, and the other area provides the third ink storage chamber 17.

A communication flow passage 18 communicating with the first ink storage chamber 11 is connected to the second ink storage chamber 16. The communication flow passage 18 has communication ports 18*a* and 18*b* at lower and upper positions, and is defined by a vertically extending recess part 18*c* (shown in FIG. 6) opened to the rear of the container main body 2 and an air shield film for closing and sealing the opening of the recess part 18*c*. A partition wall 19 having two lower and upper communication ports 19*a* and 19*b* communicating with the inside of the first ink storage chamber 11 is provided upstream from the communication flow passage 18. The communication port (first communication port) 19*a* is disposed at a position opened to the inside of the high-concentration ink layer a (shown in FIG. 10(*a*)) formed in the lower area in the first ink storage chamber 11. The communication port (second communication port) 19*b* is disposed at a position opened to the inside of the low-concentration ink layer b formed in the upper area in the first ink storage chamber 11. Accordingly, such an ink flow passage (compartment) is formed wherein the ink passing through the communication ports 19*a* and 19*b* from the first ink storage chamber 11 flows into the lower communication port 18*a* of the communication ports 18*a* and 18*b*.

On the other hand, the third ink storage chamber 17 is formed with the differential pressure regulating valve storage chamber 33 (shown in FIG. 6) for storing the differential pressure regulating valve 52 (membrane valve) and the filter chamber 34 (shown in FIG. 5) for storing a filter 55 (shown in FIG. 7) by a laterally elongating partition wall 22 and an annular partition wall 24. The partition wall 25 is formed with the through holes 25*a* for introducing ink (pigment) passed through the filter 55 into the differential pressure regulating valve storage chamber 33 from the filter chamber 34.

The partition wall 24 is formed at a lower part with the partition wall 26 having the communication port 26*a* between the partition wall 24 and the partition wall 101, and is formed on one side with the partition wall 27 having the communication port 27*a* between the partition wall 24 and the frame 14. The communication passage 28 communicating with the communication port 27*a* and extended in the up and down direction is provided between the partition wall 27 and the frame 14. A through hole 29 communicating with the filter chamber 34 through the communication port 24*a* and an area 31 is defined to be continuous to an upper part of the communication passage 28.

The through hole 29 is formed by a partition wall (annular wall) 30 continuous to the partition wall 27.

The area 31 is formed by the partition walls 24 and 30 and a partition wall 30*a* (shown in FIG. 6). The area 31 is formed deep at one end part of the container main body 2 (portion communicating with the through hole 29) and shallow at an opposite end part (portion communicating with the filter chamber 34).

The differential pressure regulating valve storage chamber 33 stores a spring 50 implemented as a helical compression spring, and the membrane valve 52 as a differential pressure regulating valve that can become elastically deformed, such as an elastomer, having a through hole 52*c*, as shown in FIG. 7. The membrane valve 52 has an outer peripheral margin fixed through an annular thick part 52*a* to the container main body 2. The spring 50 is supported at one end part by a spring bracket part 52*b* of the membrane valve 52, and at an opposite end part by a spring bracket part 53*a* of the lid body 53.

Numeral 54 denotes a frame formed integrally with the thick part 52*a* of the membrane valve 52. Numerals 56 and 57 denote air shield films disposed on the front and the rear of the container main body 2.

The filter 55 for allowing ink to pass through and capturing dust, etc., is placed in the filter chamber 34, as shown in FIG. 7. The openings of the filter chamber 34 and the differential pressure regulating valve storage chamber 33 are sealed with liquid (ink, air) shield films. Accordingly, when the pressure in the ink supply port 4 lowers, the membrane valve 52 is separated from a valve sheet part 25*b* against the urging force of the spring 50. Thus, ink passed through the filter 55 passes through the through hole 52*c*, and flows into the ink supply port 4 through the flow passage formed by the recess part 35. When the ink pressure in the ink supply port 4 rises to a predetermined value, the membrane valve 52 sits in the valve seat part 25*b* by the urging force of the spring 50, shutting off the flow of ink. Such operation is repeated, whereby ink is supplied to the ink supply port 4 while a constant negative pressure is maintained.

[Air Flow Passage System]

As shown in FIG. 6, the container main body 2 is formed on the rear with a meander groove 36 for raising flow passage resistance, a wide recessed groove 37 opened to the atmosphere, and a recess part 38 (space part) almost rectangular in a plan view, which is adjacent with the second ink storage chamber 16 through a partition wall 602. The recess part 38 is provided with a frame 39 and ribs 40, onto which an air permeable film is stretched and fixed, thereby forming an atmospheric ventilation chamber. A through hole 41 is made in the bottom part (wall part) of the recess part 38, and is made to communicate with an elongated area 43 defined by the partition wall 42 (shown in FIG. 5) of the second ink storage chamber 16. The area 43 has a through hole 44, and is made to communicate with the atmospheric open chamber 501 (shown in FIG. 8) through a communication groove 45 defined by a partition wall 603 and a through hole 46 opened to the communication groove 45.

According to the configuration, when the ink cartridge 1 is mounted to the cartridge holder 71 as shown in FIG. 9, the valve operation rod 70 of the cartridge holder 71*a* buts the operation arm 66 of the ink cartridge 1 shown in FIG. 8 for moving the convex part 66*b* (press member 61) to the valve body side. Accordingly, the valve body 65 is separated from the opening peripheral margin of the through hole 60, so that the first ink storage chamber 11 shown in FIG. 5 is opened to the recess part 38 (atmosphere) shown in FIG. 6 through the through holes 67, 60, and 46, the groove 45, the through hole 44, the area 43, the through hole 41, etc. A valve body (not shown) in the ink supply port 4 is opened by insertion of the ink supply needle 72.

As the valve body in the ink supply port 4 is opened and ink (pigment ink) is consumed by the record head 112, the pressure of the ink supply port 4 falls below a stipulated value. Thus, the membrane valve 52 in the differential pressure regulating valve storage chamber 33 shown in FIG. 7 is opened (if the pressure of the ink supply port 4 rises above the stipulated value, the membrane valve 52 is closed), ink in the differential pressure regulating valve storage chamber 33 of the upper ink storage chamber flows into the record head 112 through the ink supply port 4.

Further, as consumption of ink in the record head 112 proceeds, ink in the first ink storage chamber 11, i.e. the lower ink storage chamber, flows into the second ink storage chamber 16 through the communication flow passage 18 shown in FIG. 5.

In this case, ink in the high-concentration ink layer a (shown in FIG. 10(*a*)) positioned in the lower area of the first ink storage chamber 11 flows into the communication flow passage 18 (shown in FIG. 6) through the communication port 19*a* (shown in FIG. 5), and ink in the low-concentration ink layer b (shown in FIG. 10(*a*)) positioned in the upper area of the first ink storage chamber 11 flows into the communication flow passage 18 through the communication port 19*b*, so that the ink in the high-concentration ink layer a and the ink in the low-concentration ink layer b merge in the communication flow passage 18.

On the other hand, as ink is consumed, air flows in through the through hole 67 (shown in FIG. 5) communicating with the atmosphere, and the ink liquid level in the first ink storage chamber 11 lowers. As ink is further consumed and the ink liquid level reaches the communication port 19*a*, ink from the first ink storage chamber 11 (opened to the atmosphere through the through hole 67 at the ink supplying time) flows into the second ink storage chamber 16 via the communication flow passage 18 together with air. Since bubbles are moved up by a buoyant force, only the ink flows into the third ink storage chamber 17 through the communication port 15*a* in the lower part of the vertical wall 15, passes through the communication port 26*a* of the partition wall 26 from the third ink storage chamber 17, moves up in the communication passage 28, and flows into the upper part of the filter chamber 34 from the communication passage 28 through the area 31 and the communication port 24*a*.

After this, the ink in the filter chamber 34 passes through the filter 55 shown in FIG. 7, flows into the differential pressure regulating valve storage chamber 33 from the through holes 25*a*, further passes through the through hole 52*c* of the membrane valve 52 separated from the valve seat part 25*b*, and then moves down in the recess part 35 shown in FIG. 6 and flows into the ink supply port 4.

The ink is thus supplied from the ink cartridge to the record head.

Therefore, in the embodiment, the ink in the high-concentration ink layer a and the ink in the low-concentration ink layer b are mixed for supply to the record head 112, so that occurrence of variations in the ink concentration can be suppressed and uniform print density and quality can be provided.

If a different kind of ink cartridge 1 is mounted to the cartridge holder 71, before the ink supply port 4 arrives at the ink supply needle 72, the identification convex part 68 (shown in FIG. 8) abuts the identification piece 73 (shown in FIG. 9) of the cartridge holder 71, thereby inhibiting entry of the valve operation rod 70. Therefore, occurrence of trouble as a different kind of ink cartridge is mounted can be prevented. In this state, the valve operation rod 70 does not arrive at the operation arm 66 either, and thus the valve body 65 is maintained in the closed valve state, preventing evaporation of the ink solvent in the first ink storage chamber 11 as it is left standing.

On the other hand, if the ink cartridge 1 is removed from the mounting position in the cartridge holder 71, the operation arm 66 is elastically restored because it is no longer supported by the operation rod 70, and the valve body 65 is elastically restored accordingly to close the through hole 60, so that communication between the recess part 38 and the first ink storage chamber 11 is shut off.

The ink flow passage in the embodiment has been described as such an ink flow passage where in the ink in the high-concentration ink layer a and the ink in the low-concentration ink layer b in the first ink storage chamber 11 flow at the ink supply time and merge in the communication flow passage 18, but the invention is not limited to it. The ink flow passage may be that shown in FIG. 11 (second embodiment) or shown in FIG. 12 (third embodiment). In this case, the ink in the high-concentration ink layer and the ink in the low-concentration ink layer can be mixed several times and the ink mixing percentage can be raised correspondingly an increase in the number of mixing times.

Second Embodiment

As shown in FIG. 11, in a third ink storage chamber 17, a vertical wall 15 is formed with a communication port 15*a* opened to the inside of a high-concentration ink layer a and a communication port 15*b* opened to the inside of a low-concentration ink layer b (the open area is about three times that of the communication port 15*a*). The communication port 15*a* is placed at the lowest position in the gravity direction in a second ink storage chamber 16.

Accordingly, when ink is supplied to a record head 112, ink flowing into the second ink storage chamber 16 from a first ink storage chamber 11 merges with ink in the high-concentration ink layer a in the second ink storage chamber 16 to pass through the communication port 15*a*, and also merges with ink in the low-concentration ink layer b to pass through the communication port 15*b*, as indicated by the arrows in FIG. 11. The ink passing through the communication ports 15*a* and 15*b* merges in the lower area of the third ink storage chamber 17 (high-concentration ink layer a) to flow toward a communication port 26*a* of a partition wall 26.

In the embodiment, the case where the flow amount ratio between the flow amount a of ink passing through the communication port 15*a* and the flow amount b of ink passing through the communication port 15*b*, a:b, is set to 1:3 (the open area of the communication port is about three times that of the communication port 15*a*) has been described, but the invention is not limited to it and the flow amount ratio a:b may be set in the range of 1:1 to 1:3. In this case, if the flow amount ratio a:b is set outside the range of 1:1 to 1:3, the flow-through resistance of the communication port 15*a* becomes too large as compared with that of the communication port 15*b* (the flow-through resistance ratio becomes insufficient), and the flow amount of ink passing through the communication port 15*a* is lessened.

Third Embodiment

As shown in FIG. 12, in a third ink storage chamber 17, a partition wall 51 having a communication port 51*a* opened to the inside of a high-concentration ink layer a and a communication port 51*b* opened to the inside of a low-concentration ink layer b is disposed between partition walls 24 and 27.

Accordingly, ink passing through a communication port 26*a* of a partition wall 26 in the lower area of the third ink storage chamber 17 (high-concentration ink layer a) merges with ink in the high-concentration ink layer a on the left of the partition wall 26 to pass through the communication port 51*a*, and also merges with ink in a low-concentration ink layer b on the left of the partition wall 24 to pass through the communication port 51*b*, as indicated by the arrows in FIG. 12. The ink passing through the communication ports 51*a* and 51*b* merges in the lower area (high-concentration ink layer a) between the partition walls 27 and 51 to flow toward a communication port 27*a* of the partition wall 27.

Thus, in each of the first to third embodiments, the case where the partition walls are formed with the communication ports to mix ink has been described, but the invention is not limited to it, and an ink guide path 61 as shown in FIG. 13 (fourth embodiment) may be provided in a filter chamber 34 to mix ink.

As shown in FIG. 13, the ink guide path 61 is formed so that it extends along the inner peripheral surface of a partition wall 24, and is opened to an area 31 (shown in FIG. 5) and the inside of the filter chamber 34. In the filter chamber 34, when ink is supplied, ink from the area 31 (communication port 24*a*) is made to flow from an upper part to a lower part.

Accordingly, when ink is supplied to a record head 112, ink passing through the area 31 is guided along the ink guide path 61 to the lower part of the filter chamber and flows from the lower part of the filter chamber to a through hole 25*a* (through hole made in the upper part of the filter chamber) while it is mixed, as indicated by the arrows in FIG. 13.

As seen in the description made above, according to the ink cartridge and the ink jet record apparatus using the ink cartridge according to the invention, the ink in the cartridge can be sufficiently mixed at the use time, so that uniform print density and quality can be obtained.

What is claimed is:

1. An ink cartridge for a recording apparatus, comprising:

an ink supply port;

a chamber containing therein pigment ink, the chamber being at least in part defined by a film member;

a flow passage, through which the pigment ink contained in the chamber can flow into the ink supply port; and a rigid member to which the film member is attached, the rigid member having a rigid wall partitioning the chamber from the flow passage, the rigid wall having a first through hole and a second through hole, both passing through the rigid wall, which are respectively located at upper and lower positions in a gravity direction when the ink cartridge is mounted to the recording apparatus, each of the first and second through holes serving as an inlet for the pigment ink from the chamber to the flow passage.

2. An ink cartridge for a recording apparatus, comprising:

an ink supply port;

a chamber containing therein pigment ink, the chamber being at least in part defined by a film member;

a flow passage for communicating the chamber with the ink supply port; and a rigid member to which the film member is attached, the rigid member having a rigid wall, wherein the flow passage has first and second communication ports, both passing through the rigid wall, for causing the pigment ink in a lower area in the chamber and the pigment ink in an upper area in the same chamber to flow and merge with each other.

3. The ink cartridge according to claim 2, wherein:

the rigid wall partitions the chamber from the flow passage, and the first and second communication ports are respectively located at upper and lower positions of the rigid wall in a gravity direction when the ink cartridge is mounted to the recording apparatus.

* * * * *